United States Patent [19]

Lindsey, Jr. et al.

[11] Patent Number: 4,671,358

[45] Date of Patent: Jun. 9, 1987

[54] WIPER PLUG CEMENTING SYSTEM AND METHOD OF USE THEREOF

[75] Inventors: Hiram E. Lindsey, Jr., Midland; Ray R. Dockins, Jr., Bryan, both of Tex.

[73] Assignee: MWL Tool Company, Midland, Tex.

[21] Appl. No.: 810,089

[22] Filed: Dec. 18, 1985

[51] Int. Cl.[4] ..... E21B 33/16

[52] U.S. Cl. ..... 166/291; 166/154; 166/156

[58] Field of Search ..... 166/291, 154, 156, 194, 166/195

[56] References Cited

U.S. PATENT DOCUMENTS

| | | | |
|---|---|---|---|
| 2,659,438 | 11/1953 | Schnitter | 166/194 |
| 3,635,288 | 1/1972 | Lebourg | 166/291 X |
| 3,768,556 | 10/1973 | Balter | 166/154 |
| 3,789,926 | 2/1974 | Henley et al. | 166/154 X |

*Primary Examiner*—Stephen J. Novosad
*Assistant Examiner*—Michael A. Goodwin

[57] ABSTRACT

A cementing system using a tubular member 43 coupled to a string of tubing 14 where upper and lower tubular liner wiper plugs (20, 21) are independently attached to and separately releasable from the tubular member. The upper tubular liner wiper plug 20 has outer liner wiper seal members, an outer latching mechanism (95) and an inner latching mechanism (52). A fluid bypass (59) is located in the liner wiper plug (20) below the wiper seal members with a check valve structure for bypassing fluid from below the seal members to the bore (45) of the tubular member in response to a pressure differential. A second check valve structure (46) is provided in the tubular member to provide a fluid bypass from the exterior of the tubular member above the seal members to the interior of the tubular member in response to a pressure differential.

The lower tubular liner wiper plug (21) is provided with upper, internal spring latch fingers (71) for releasable attachment to the tubular member and an internal, releasable valve sleeve 90 in a bore 89 and a valve opening 85 in a tubular depending section of the wiper plug. A pump down plug member 100 locks into the releasable valve sleeve 90 above the valve opening 85 to form a lower plug assembly. When the lower plug assembly reaches a lower landing collar, the releasable valve sleeve 90 is released by pressure and moves to open the valve opening 85 to permit cement slurry to pass through the valve opening 85 to the float shoe and through to the annulus of the well bore and the liner.

20 Claims, 9 Drawing Figures

WIPER PLUG CEMENTING SYSTEM AND METHOD OF USE THEREOF

FIELD OF THE INVENTION

This invention relates to cementing systems for cementing liners in well bores which traverse earth formations, and more particularly to a system for obtaining proper release of cementing wiper plugs on a tubular member in a liner hanger and proper valve operation at a casing shoe during a cementing operation to admit cement slurry to a casing shoe.

BACKGROUND OF THE PRESENT INVENTION

It is established practice in the cementing of liner or casing in a well bore to drill a well bore of large diameter to a certain depth and then line the drilled well bore with a casing which is cemented in place, which is sometimes called surface or intermediate casing. Thereafter, a smaller size bit is used and a continued extension of the borehole is made into the earth formations and a liner is cemented in place in this continued extension of the borehole. Thus, a borehole is comprised of a series of borehole sections of decreasing diameter and a string of pipe is cemented in place in each borehole section and overlaps the bottom end of an adjacent liner or casing.

To cement the liner or string of pipe in place, the liner, which is a tubular member, is lowered through the cemented casing in the borehole and suspended by a liner hanger in the bottom end of the casing next above the borehole section receiving the liner. Between the liner and the drilled borehole is an annular space or borehole annulus. A cement a slurry is pumped down a tubing string and through a connection with the liner hanger around the bottom of the liner and into the borehole annulus. After the cement slurry is properly positioned in the borehole annulus and hardens, the cement provides a seal against fluid migration vertically in the borehole annulus and permanently affixes the liner in the borehole. There may be a number of liners utilized in a well bore depending upon the depth to which the well is being drilled. As in most drilling operations, the drilling of the well bore is conducted with a mud or liquid which contains various materials such as weighting materials which provide the hydrostatic pressure control as the drilling operation is conducted so that the hydrostatic pressure of mud in the well bore is always calculated to balance, approximately any expected pressure that may be encountered by gas or oil formations traversed by the borehole. The use of the drilling mud thus provides a control against blowout of the well and the consequence hazards therefrom. The main job of the drilling mud, besides formation control is to return the drilled cuttings to the surface.

In the cementing of a liner in a borehole annulus during the drilling operation, the liner has a float shoe at its lowermost end which is broadly described as a closure member with orifices to permit the flow of fluids from the bottom of the liner into the annulus between the liner and the borehole and a one way check valve to prevent reverse flow of cement back into the liner. To set the liner in another pipe in the well bore, a liner hanger is typically provided at the top of the liner. The liner hanger has a system for providing a releasable connection with a setting tool attached to a string of tubing extending from the earth's surface. After setting the liner hanger in the next above string of pipe in the borehole, a cementing string of pipe is utilized to inject a cement slurry into the liner and then flowing through the float shoe on the liner where the cement slurry is forced upwardly in the borehole 35 annulus between the liner and the well bore and displaces the drilling fluid or mud in the borehole annulus towards the earth's surface until such time as the top of the slurry of cement in the borehole annulus is properly positioned.

Because the size of the liner and the size of the borehole are known factors, it is possible to calculate the volume of cement slurry necessary to fill the borehole annulus between the liner and a well bore to a proper level. It is also common in introducing the cement slurry to provide isolation of the cement slurry between the mud in the borehole and between the fluid used to drive the cement slurry down the string of pipe. The isolation devices also wipe the mud from the wall of the cementing string of pipe so that mud in the pipe does not contaminate the cement slurry. The isolation devices or means used in the cementing string of pipe or tubing to a liner hanger are called pump down plugs. The pump down plugs have elastomer cup members for wiping the wall of the string of tubing and for permitting the application of mud fluid pressure to the slurry of cement, while separating the cement slurry from borehole fluids or mud.

To this end, as in the prior art, there have been provided on a tubular member (usually in the end of the string of pipe) upper and lower tubular cementing wiper plugs which are releasably yet independently attached to the tubular member. The cementing wiper plugs have outer elastomer cup members for wiping the wall of the liner. The cementing wiper plugs are respectively adapted to receive one of the pump down plugs and respectively form an isolation assembly means in the liner.

At spaced apart locations near the casing shoe, there are upper and lower wiper plug catchers which trap or catch the respective upper and lower cementing wiper plugs.

In the operation, a first cementing pump down plug is inserted into the tubing string at the surface of the earth and is followed by the slurry of cement which pushes the cementing pump down plug downwardly through the tubing string and the drilling mud in front of the pump down plug is displaced. When the first cementing pump down plug latches into the bore of the lower cementing liner wiper plug, the pump down plug and wiper plug act as a single movable seal assembly to close off the cross section of the liner and also serve to wipe the walls of the liner while moving toward the float shoe. Thus, there is a minimum of intermix of the slurry of cement with the drilling mud and the mud on the pipe wall is also removed preventing it from contaminating the cement. When the calculated volume of the slurry of cement necessary to fill the borehole annulus between the liner and the borehole has been placed in the tubing string, a second follow-up pump down plug is disposed in the string of tubing to provide a single moving, sealing plug member behind the column of the slurry of cement in the string of tubing. Another fluid such as drilling mud is supplied to provide the driving force on the upper pump down plug behind the column of cement. When the second or upper pump down plug engages and locks into the bore of the upper cementing liner wiper plug on the tubular member, the upper pump down plug and liner wiper plug assembly travel downward behind the column of cement in the liner. Thus, there are sealing assembly devices which are forward and rearward of the column of cement slurry in the liner and travel downwardly with the column of cement until the lowermost wiper plug assembly engages the lower plug catcher located in the liner above the float shoe. A valve in the cementing shoe is open during the pumping operation permitting the cement slurry to enter through the float shoe into the borehole annulus between the liner and the borehole. Cement slurry then is moved up in the borehole annulus as the rearward cementing plug assembly travels downwardly until the rearward plug assembly reaches a second plug catcher in a collar in the liner and locks in position in the landing collar, thus trapping the cement slurry in the borehole annulus between the liner and the borehole.

The problem with prior art systems is premature release of the cementing wiper plugs on the tubular member in the liner hanger and/or faulty valve operation at the cementing float shoe when the cementing plug assembly reaches the lower catcher in the cementing float shoe.

For example, in U.S. Pat. No. 3,364,996 there are spaced apart upper and lower wiper sleeves or cementing wiper plugs releasably secured to a tubular member on a liner hanger. The upper liner wiper plug has a first smaller diameter bore relative to the bore of the string of pipe or tubing while the lower liner wiper plug has a still smaller bore. The first pump down plug preceding the cement slurry in the tubing string engages the smaller bore of the lower liner wiper plug and releases the lower liner wiper plug from the tubular member so that the assembly can move downwardly through the liner in front of the cement slurry until it reaches a landing collar or catcher above the cementing float shoe. The second pump down plug following the cement slurry in the string of tubing next engages the bore of the upper liner wiper plug and releases the upper liner wiper plug from the tubular member to move the assembly downwardly in the liner and where it ultimately locks in an upper landing collar above the cementing float shoe.

When the first pump down plug and lower liner wiper plug reach a landing collar, the landing collar has a sleeve valve which is part of the cementing float shoe where the sleeve valve is opened to admit or bypass the cement slurry to the borehole annulus.

Another type of dual cementing plug system is shown in U.S. Pat. No. 3,635,288 where the first pump down plug engages a smaller diameter bore in the lower liner wiper plug and where the pump down plug and the lower liner plug define a built in valve structure. The upper liner wiper plug has a bore matching the bore of the running in string and provides latching fingers which spring into latching position in the bore to catch the second cementing dart.

In both of the foregoing devices, a major problem of premature release of the two liner wiper plugs occurs when a differential pressure is introduced across the plugs during cementing the neither the bypass valve in the cementing float shoe nor a bypass valve operated by a cementing float shoe have been reliable.

THE PRESENT INVENTION

The present invention is embodied in a cementing system in which a tubular member on the string of tubing is provided with upper and lower tubular cementing or liner wiper plugs which are independently attached to and separately releasable from the liner setting tool. A one way pressure bypass means is provided between the cementing plugs and above the upper liner wipe plug. Thus, creation of a pressure differential across the two liner wiper plugs is eliminated. The lower liner wiper plug and pump down plug are arranged to provide valve means in the liner wiper plug which is independently operated by pressure in a well bore.

The upper tubular liner wiper plug is provided with outer liner wiper seal members, an outer latching mechanism and an inner latching mechanism. A fluid bypass means is disposed in the liner wiper plug below the wiper seal members and includes a check valve structure for passing fluid from below the seal members to a location in the liner hanger bore. A second check valve structure is provided in the liner hanger to provide a fluid bypass from the exterior of the liner setting tool above the seal member to the interior of the liner setting tool in response to a pressure differential.

The lower tubular liner wiper plug is provided with upper, internal spring latch fingers for internal and independent releasable attachment to the liner setting tool and an internal, releasable valve sleeve in a bore and an valve opening in a tubular depending section of the plug. The second pump down plug member locks into the releasable valve sleeve above the valve opening. When the lower plug assembly reaches the lower landing collar, the releasable valve sleeve is released by pressure and moves to open the valve opening to permit cement slurry to pass through the valve opening to the float shoe and through to the annulus of the well bore and the liner.

DESCRIPTION OF THE PRESENT INVENTION

Figure 1:
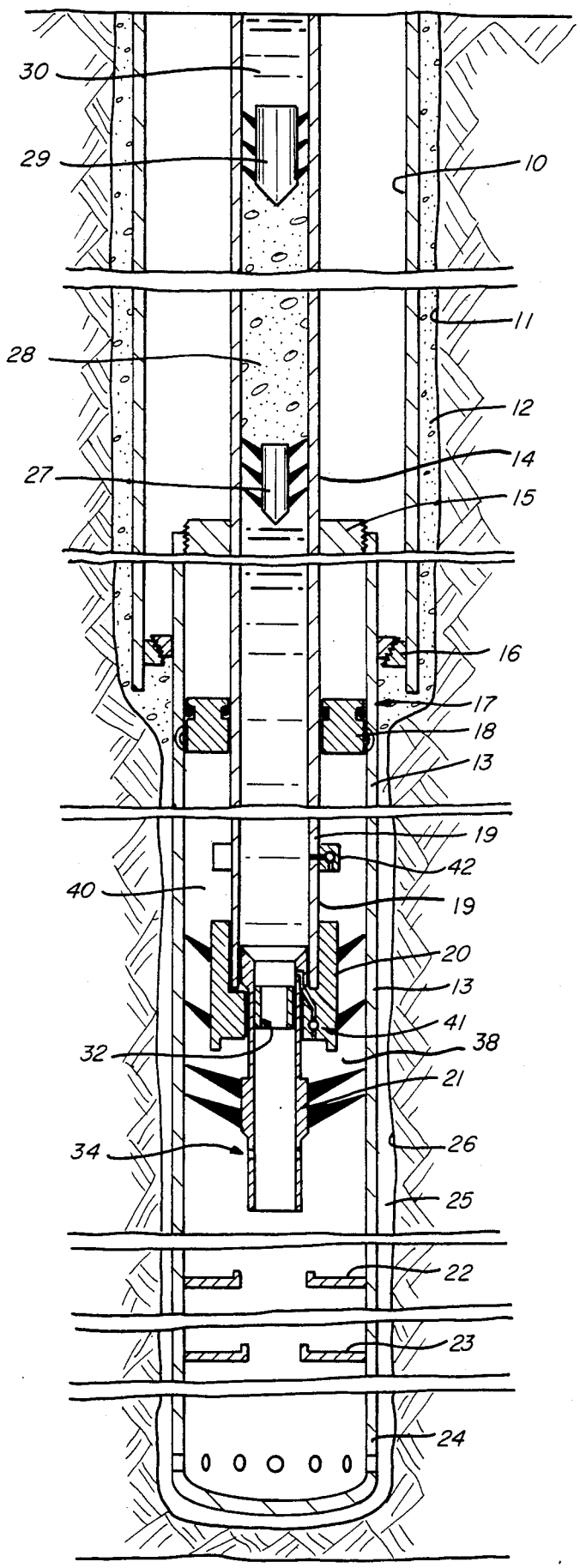
FIG. 1 illustrates schematically a cementing system embodying the present invention.

Referring now to FIG. 1, the present invention is illustrated schematically in a well bore environment. From the earth's surface, a surface casing 10 is cemented in a borehole 11 by a column of cement 12. A string of pipe or tubing 14 extends between the earth's surface and the top of a tubular liner 13. The string of pipe or tubing 14 is connected to a cementing manifold and pump down plug dropping head at the earth surface (not shown) and to a liner setting tool 15 in the well bore.

As shown in FIG. 1, the liner 13 includes liner hanger slips 16 and a setting adapter 17 in which a pack-off assembly 18 is sealingly and releasably locked. The string of pipe or tubing 14 is slidably and sealingly received in the pack-off assembly 18 and at the lower end of the string of pipe 14 is a tubular member 19 which releasably receives an upper tubular wiper plug 20 and a lower tubular wiper plug 21 which are independently releasably attached to the tubular member 19. As shown in FIG. 1, the liner 13 at its lower end includes an upper plug catcher or landing collar 22 and a lower plug catcher or landing collar 23. At the terminal end of the liner 13 is a casing shoe 24.

As shown in FIG. 1, the liner hanger slips 16 are initially set just above the lower end of the casing 10. After setting the liner hanger slips 16, the string of pipe 14 with the pack-off assembly 18 is positioned in the setting adapter 17 and the pack-off assembly is releasably locked to the setting adapter 17. After circulating the mud from the surface through the string of pipe 14 and return of the mud to the earth's surface via a borehole annulus 25 between the liner 13 and the borehole 26, a first pump down plug 27 is released from the surface manifold and is driven down the string of pipe 14 by a cement slurry 28. At an appropriate time when a calculated volume of the cement slurry 28 has been pumped into the string of pipe 14, a second cementing pump down plug 29 is released from the manifold and is located behind the cement slurry 28 to separate the cement slurry 28 from drilling mud 30 for driving the cement slurry 28. The drilling mud 30 also procedes the pump down plug 27.

The first pump down plug 27 engages and closes off the bore of the lower cementing liner wiper plug 21 and is latched to a releasable valve sleeve 32 in the cementing liner wiper plug 21. The lower cementing liner wiper plug 21 is then released from the end of the tubular member 19 and the assembly moves downwardly until it engages and is latched in the lower plug catcher 23. Upon latching with the lower plug catcher 23, the valve sleeve 32 in the plug 21 is released (by virtue of applied pressure) to access a valve opening 34 in the bore of the plug 21 above the pump down plug 27 so that cement slurry above the pump down plug 27 passes through the valve opening 34 to the cementing float shoe 24 and into the annulus 25 between the liner 13 and the borehole 26. Cement slurry is moved up the borehole annulus 25 and subsequently, the upper pump down plug 29 engages the bore of the upper cementing liner wiper plug 20 and closes off its bore. The upper cementing liner wiper plug 20 is then released from the tubular member 19 and the assembly travels downwardly with the second pump down plug until it engages the upper plug catcher 22. Upon latching of the plug 20 in the upper plug catcher 22, the bore of the liner 13 is closed off and retains the cement slurry in position in the borehole annulus 25 until the cement sets. It is of course, possible that the upper liner wiper plug 20 will be released by the pump down plug 29 prior to the time that the lower liner wiper plug 21 reaches the catcher 23 dependent upon the relative volumes of cement and well bore fluid already in place. The above system minimizes cement contamination by separating the drilling mud and mud materials on the inside of the pipe and liner by the wiper members on the pump down plug and liner wiper plugs both ahead of and behind the cement column.

The upper liner wiper plug 20 has a one-way fluid bypass 41 below its cup members for bypassing fluid under pressure in the space 38 between the plugs 20 and 21 to the interior of the tubular member 19. A collar 42 connects to the tubular member 19 above the cup members of the upper wiper plug 20 has a one way fluid bypass valve for bypassing fluid under pressure in the space 40 above the plug 20 to the interior of the tubular member 19.

Figure 2:
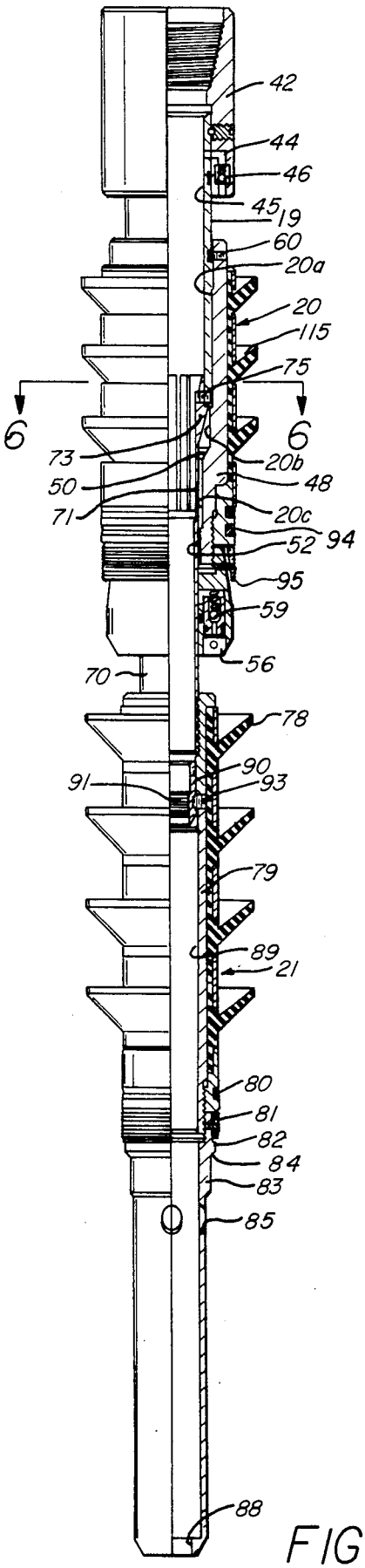
FIG. 2 is an illustration in partial longitudinal cross-section of the lower end of a tubing string with attached upper and lower liner wiper plugs.

Referring now to FIG. 2, the tandem arranged cementing liner wiper plugs 20 and 21 are illustrated in greater detail. In FIG. 2, a tubular member or collar 42 is adapted for connection to the end of a string of pipe 14 which is adapted to convey fluid under pressure. Depending downwardly from the collar 42 is a tubular plug collar mandrel or member 19.

The tubular collar 42 has a one way check valve means to provide a fluid bypass from the exterior of the collar to the interior of the collar. The check valve means includes lengthwise extending bore 44 in the collar 42 which defines a passageway opening to the interior bore 45 of the in the tubular member 19. A one way check valve 46 including a spring and ball member are disposed in the bore 44 so as to permit one way flow of fluid from the exterior of the collar to the internal bore 45 of the tubular member 19.

The upper liner wiper plug 20 includes a tubular body member 48 having a series of diametrically stepped, inner bores **20*a*–20*c*. Bore 20*a* is slidably received on the coupling tubular member 19 and has an upwardly facing shoulder formed by bores 20*a* and 20*b*. A shear pin 60 releasably interconnects the liner wiper plug 20 to the coupling tubular member 19. The bores 20*b* and 20*c* define an upwardly facing and inclined landing shoulder 50 for a pump down plug. The bore 20*c* is serrated or has teeth intermediate of its length to provide a latching groove surface 52 for a latching element on a pump down plug. At the lower end of the bore 20*c*, an O-ring seal 54 (see FIG. 5) provides a seal between the body members 48 of the liner wiper plug and the outer surface on an upper tubular section 70 of the lower plug 21**.

Figure 5:
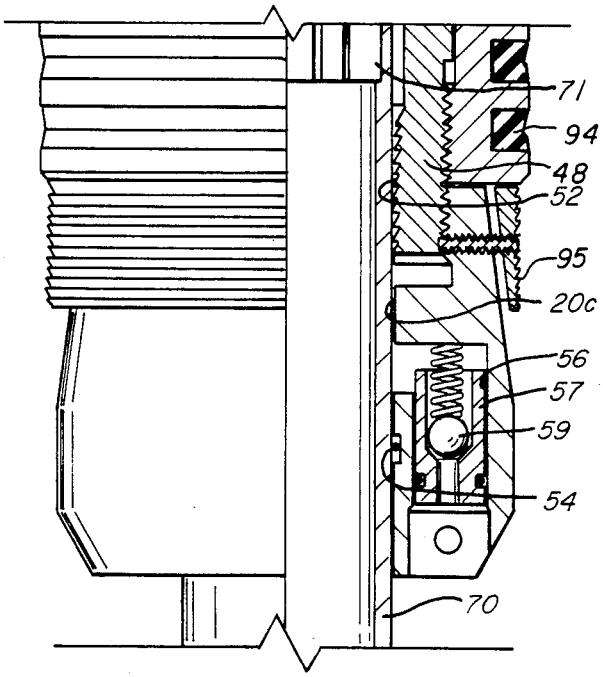
FIG. 5 is a view in partial cross-section of the lower end of the upper liner wiper plug for illustrating details of the structure.
Figure 6:
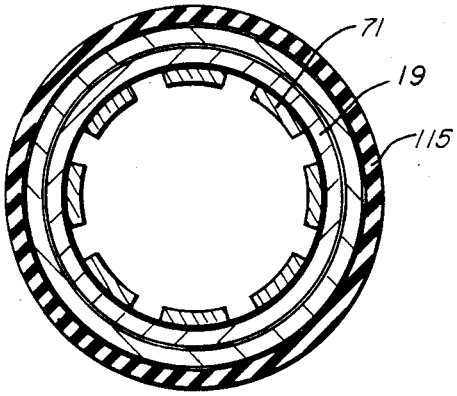
FIG. 6 is a view taken along line 6—6 of FIG. 2 for showing the collet fingers of the lower liner wiper plug.
Figure 7:
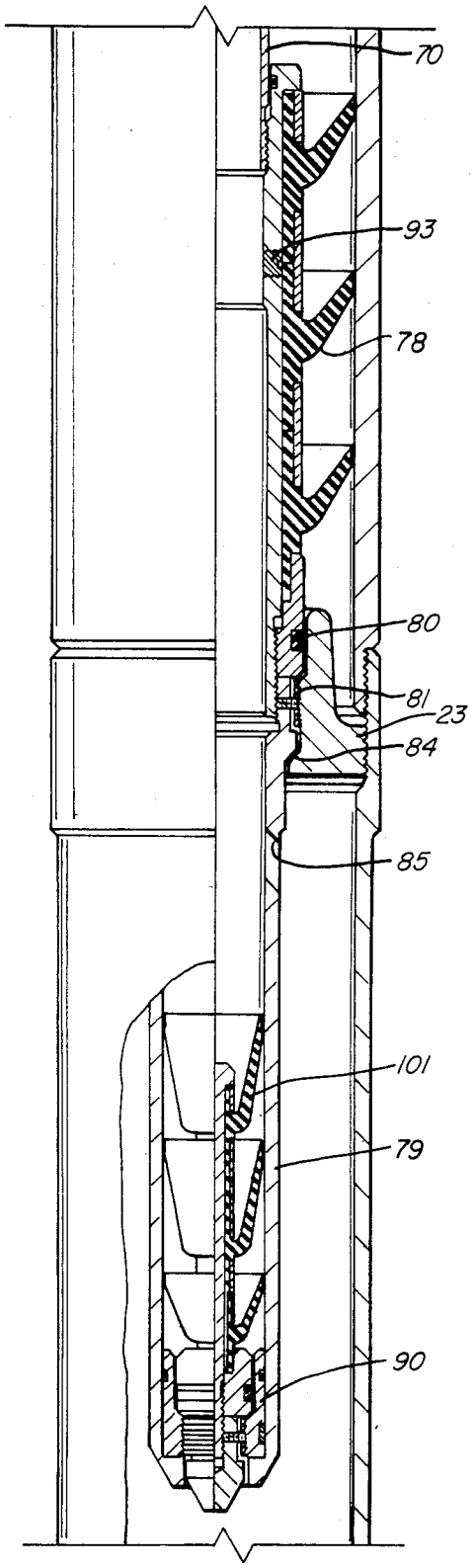
FIG. 7 is a view showing the lower liner wiper plug is a plug lower catcher with the valve in the liner wiper plug actuated.
Figure 8:
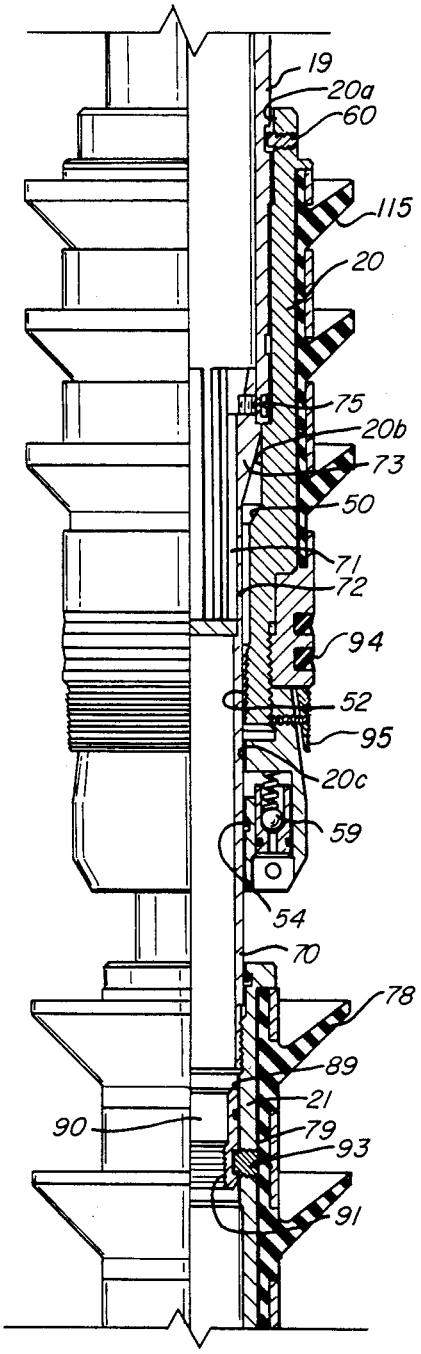
FIG. 8 is a view in partial cross-section showing details of the upper liner wiper plug and the sleeve valve in the lower liner wiper plug.

Referring to FIG. 5, in the end surface of the plug 20 is a one way bypass means which includes a lengthwise extending bore 56 which sealingly receives a tubular seating member 57 which is locked in place by a snap ring. In an enlarged bore of the seating member 57 in a ball and spring which provide a one way check valve 59. The bore 56 is ported to the bore **20*c* of the plug 20 above the O-ring seal 54 by an annular recess at a location above the O-ring seal 54. Thus, a one-way passageway is defined from the outer end surface of the plug 20 through the check valve 59 and through the annulus defined by the outer wall of a tubular section 70 of the plug 21 and the bore sections 20(*a*—*c*) to the interior 45 of the member 43 tubular member 19**.

The second and lower liner wiper plug 21 includes an upper tubular section 70 which extends through the O-ring seal 54 and terminates with a number of circumferentially spaced collet spring fingers 71 which are formed by longitudinal slots circumferentially disposed around the tubular section 70. The collet fingers 71 have a thin wall section 72 and terminal, thick wall sections 73. A shear pin 75 (see FIG. 2) interconnects the fingers 71 to the coupling tubular member 19. Midway of the length of the wiper plug 21 and below the plug 20 are external wiper seal means 78 which are mounted on a tubular member 79. Below the wiper seal means 78 are annular external seal means 80 and an annular outer ratchet ring 81 in an annular groove. Below the ratchet ring 81 the tubular member 79 has stepped diameter portion 82, 83 forming a downwardly facing landing shoulder 84. Below the shoulder 84 are a series of valve ports or openings 85 in the wall of the member 79. The lower end of the member 79 has sufficient length to accommodate a pump down plug and has an internal flange 88 forming a landing stop or shoulder.

In a bore 89 of the tubular member 79 is a valve sleeve 90 with an internal ratchet thread 91, an outer seal member and a shear pin 93 which interconnects the valve sleeve to the member 79.

Figure 3:
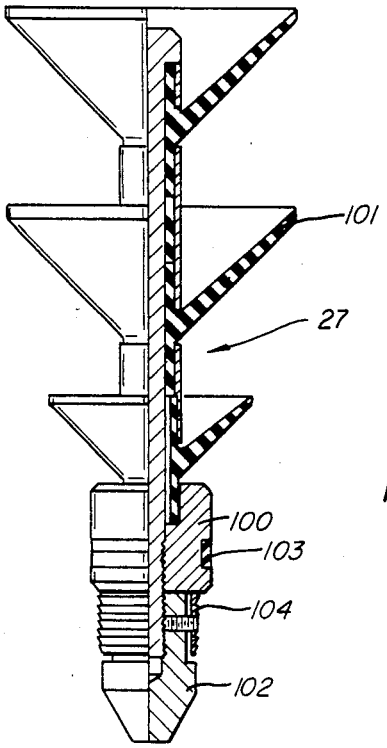
FIG. 3 is a view of a pump down plug for use with the lower liner wiper plug.

A first pump down plug member 27, as shown in FIG. 3, includes a pump down plug body 100 which carries external annular elastomer wiper means 101, a lower solid latching nose member 102 and an intermediate annular seal means 103. The nose member has external ratchet lock means 104.

When the pump down plug member 27 passed through the string of tubing 14, the wiper means 101 will wipe the wall of the tubing or running in string. When the nose member 102 enters into the valve sleeve 90, the ratchet lock means 104 latches to the valve sleeve ratchet 91 and the seal means 103 seals off the bore of the valve sleeve 90. With the pump down plug member latched into the valve sleeve 90, pressure on the pump down plug member 27 causes the shear pin 75 (see FIG. 2) to shear so that the collet fingers 71 of the liner wiper plug 21 depress inwardly allowing the assembly of the pump down plug member 27 and lower liner wiper plug member 21 to travel toward the lower plug catcher 23. When the assembly reaches the lower plug catcher 23 and the downwardly facing landing surface 84 on the liner wiper plug 27 engages an upwardly facing landing surface in the catcher 23 and the ratchet ring 81 locks the assembly to the catcher 23 in a position where the bore of the catcher 23 is sealed by the seal means 80. Further applied pressure will cause the valve sleeve shear pin 93 to shear so that the valve sleeve 90 and the pump down plug member 27 can move downwardly in the elongated tubular member 79 to a position where the wiper means 101 on the plug 27 are below valve openings 85 in the elongated tubular thereby member 79 thereby permitting cement slurry to pass through the valve openings 85.

Figure 4:
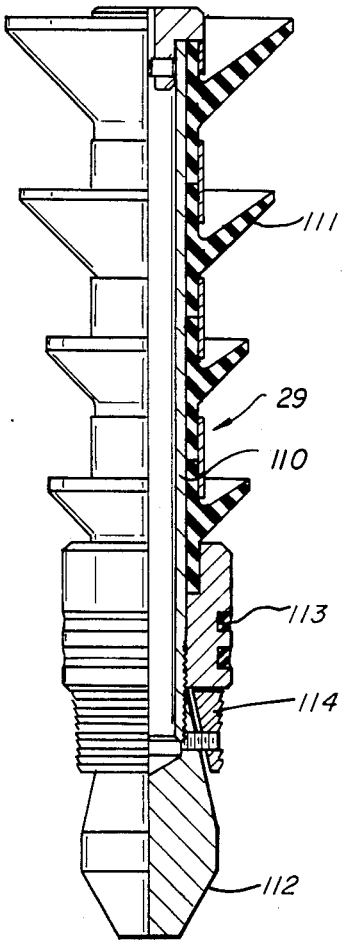
FIG. 4 is a view of a pump down plug for use with the upper liner wiper plug.
Figure 9:
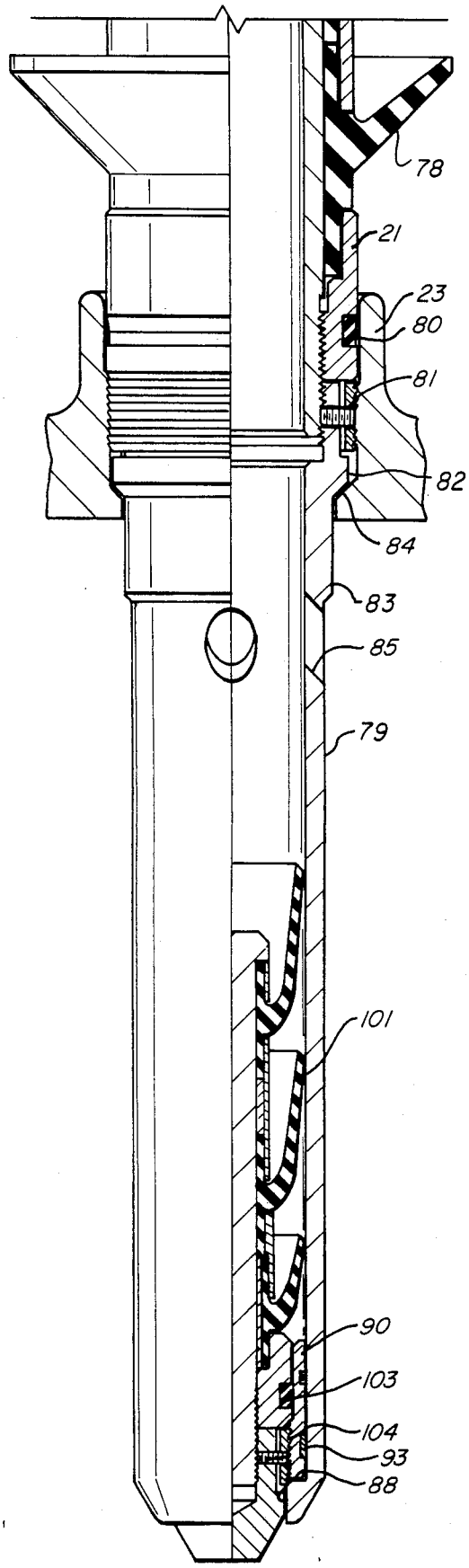
FIG. 9 is a view in partial cross-section illustrating the sleeve valve in an actuated position similar to the view of FIG. 7.

A second pump down plug member 29, as shown in FIG. 4 includes a tubular pump down plug body 110 which carries external annular wiper means 111 for wiping a tubing string. The pump down plug body 110 has a lower solid latching nose member 112 and an intermediate outer annular seal means 113. When the pump down plug member 29 is passed or pumped through the string of tubing, the nose member 112 enters into the bore 20*c* of the liner wiper plug 20 where the seal means 113 seals off the bore and the nose member has latch means 114 which latch the pump down plug to the internal serrations 52 of the liner wiper plug 20 when the downwardly facing landing shoulder 115 on the pump down plug member engages the upwardly facing landing shoulder 50 in the liner wiper plug. Continued pressure then causes the shear pin 60 to shear so that the interconnected pump down plug member and liner wiper plug assembly travel downwardly to engage the upper plug catcher 22. When the assembly is in the bore of the upper plug catcher 22, the catcher bore (not shown) is sealed by a sealing means 94 and a ratchet ring 95 engages the ratchet in the plug catcher to prevent upward movement of the plug relative to the catcher. The upper catcher 22 is constructed as the catcher 23 illustrated in FIG. 9.

Returning to FIG. 2, it can be appreciated that fluid under pressure from below the wiper plugs 20, 21 can bypass both of the wiper seals 78 and 115 because the seals are designed only to hold pressure from above the wiper plugs. If fluid under pressure bypasses the wiper seals 78, then an increased pressure remains trapped between the two wiper seals 78 and 115 or above the upper wiper seals 115. Thus, if lower pressure appears in the interior bore 45 of the tubular member an in the tubing string tubing string, then a pressure differential can occur across one or both wiper plugs 20 or 21. The pressure differential can produce suffficient force to prematurely shear the pins 60 and 75 and cause premature release of the wiper seal members before a pump down plug or a pair of pump down plugs latch into the liner wiper plug or plugs. This causes a loss of the utility and function of the liner wiper plugs.

In the present invention, with a bypass bore 56 and a one way check valve provided in the wiper plug 20 to bypass fluid under pressure from a location between the seals on the plugs 20 and 21 to the interior of the tubing string a pressure balance is provided across the wiper seal members 78 so that the liner wiper plug 21 can not prematurely release.

Above the upper liner wiper plug 20, the bypass passageway 44 bore with a one way check valve disposed in a collar in the string of tubing bypasses fluid from the annulus area above the plug 20 to the interior of the tubular member. Thus, a low pressure condition in the string of tubing relative to the annulus above the seals of the wiper plug 20 is balanced by the passageway and check valve.

It will be apparent to those skilled in the art that various changes may be made in the invention without departing from the spirit and scope thereof and therefore the invention is not limited by that which is enclosed in the drawings and specifications, but only as indicated in the appended claims.

We claim:

1. In method for cementing a well liner in a well bore traversing earth formations wherein a liner in a borehole has wiper plug catcher means at its lower end located above float shoe orifice means in communication with the annulus between the liner and the borehole, and wherein a string of tubing or drill pipe is releasably connected to the liner in a sealed relationship relative to the bore of the liner, and wherein the string of tubing or drill pipe has connected thereto, a tubular member which is disposed in the liner and wherein the tubular member has releasably attached upper and lower tubular wiper plug means with each of said wiper plug means having sealing means in a sealing relationship with respect to the bore of the liner, wherein said lower wiper plug means has a tubular valve sleeve releasably connected in the lower wiper plug means above a valve passageway providing a communication path between the interior and the exterior of said lower wiper plug means below the sealing means, the steps of, introducing a volume of cement slurry into the string of tubing or drill pipe between a first lower pump down plug and a second upper pump down plug where the pump down plugs have seal means in a sealing relationship to the string of tubing or drill pipe, applying pressure to the second upper pump down plug for moving the volume of cement slurry and pump down plugs through the string of tubing or drill pipe, coupling the first lower pump down plug in a sealing relationship with the tubular valve sleeve in the lower wiper plug means, continuing the application of pressure to the second pump down plug for disconnecting the coupled lower wiper plug means from the tubular member after the first lower pump down plug is coupled in the tubular valve sleeve and moving the volume of cement slurry through the liner between the lower wiper plug means coupled with the lower pump down plug and the second upper pump down plug, coupling the second upper pump down plug in a sealing relationship to the upper wiper plug means, continuing the application of pressure to the second upper pump down plug for disconnecting the coupled upper wiper plug means from the tubular member after the second upper pump down plug is coupled in the upper wiper plug means and moving the volume of cement slurry through the liner between the lower wiper plug means coupled with the lower pump down plug and the upper wiper plug means coupled with the upper pump down plug, upon the lower wiper plug means reaching said wiper plug catcher means, coupling the lower wiper plug means to the plug catcher means and continuing the application of pressure for releasing the valve sleeve and first pump down plug and moving the valve sleeve and first pump down plug to a location below the valve passageway so that cement slurry can be placed in communication with the float sleeve orifice means; and continuing the application of pressure for displacing the volume of cement slurry into the annulus between the liner and the borehole.

2. The method as set forth in claim 1 and further including the step of placing the annular space between the tubular member and the liner above the sealing means on the upper wiper plug means in fluid communication with the interior of the tubular member by a one way fluid pressure bypass for equalizing higher pressure in the annular space to lower pressure in the tubular member prior to and during the movement of the volume of cement slurry through the string of tubing or drill pipe for preventing premature release of the upper wiper plug means due to differential pressure.

3. The method as set forth in claim 1 and further including the step of placing the annular space between the sealing means on the upper and lower wiper plug means and between the tubular member and liner in fluid communication with the interior of the tubular member by a one way fluid pressure bypass for equalizing higher pressure in the annular space to lower pressure in the tubular member prior to and during movement of the volume of cement slurry through the string of tubing or drill pipe for preventing premature release of the lower wiper plug means due to differential pressure.

4. The method as set forth in claim 1 and further including the step of placing a first annular space between the tubular member and the liner above the sealing means on the upper wiper plug means in fluid communication with the interior of the tubular member by a one way fluid pressure bypass for equalizing higher pressure in the first annular space to lower pressure in the tubular member prior to and during the movement of the volume of cement slurry through the string of tubing or drill pipe for preventing premature release of the upper wiper plug means due to differential pressure and the step of placing a second annular space between the sealing means on the upper and lower wiper plug means and between the tubular member and liner in fluid communication with the interior of the tubular member by a one way fluid pressure bypass for equalizing higher pressure in the second annular space to lower pressure in the tubular member prior to and during movement of the volume of cement slurry through the string of tubing or drill pipe for preventing premature release of the lower wiper plug means due to differential pressure.

5. A method for cementing a well liner in a well bore traversing earth formations wherein a liner in a borehole is releasably connected to a string of tubing or drill pipe and wherein the string of tubing is in a sealed relationship relative to the bore of the liner, and wherein the string of tubing or drill pipe has connected thereto, a tubular member which is disposed in the liner and wherein the tubular member has releasably attached upper and lower tubular wiper plug means with each of said wiper plug means having sealing means in a sealing relationship with respect to the bore of the liner, the method comprising, introducing a volume of cement slurry into the string of tubing or drill pipe between a first lower pump down plug and a second upper pump down plug where the pump down plugs have seal means in a sealing relationship to the string of tubing or drill pipe, applying pressure to the second upper pump down plug for moving the volume of cement slurry and pump down plugs through the string of tubing or drill pipe, placing an annular space between the sealing means on the upper and lower wiper plug means and the liner in fluid communication with the interior of the tubular member by a one way fluid pressure bypass for equalizing higher pressure in the annular space to lower pressure in the tubular member prior to and during movement of the volume of cement slurry through the string of tubing or drill pipe for preventing premature release of the lower wiper plug means due to differential pressure, coupling the first lower pump down plug in a sealing relationship with the lower wiper plug means, continuing the application of pressure to the second pump down plug for disconnecting the lower wiper plug means from said tubular member after the first lower pump down plug is coupled to the lower wiper plug means and moving the volume of cement slurry through the liner between the lower wiper plug means coupled with the lower pump down plug and the second upper pump down plug, coupling the second upper pump down plug in a sealing relationship to the upper wiper plug means, continuing the application of pressure to the second upper pump down plug for disconnecting the coupled upper wiper plug means from the tubular member after the second upper pump down plug is coupled in said upper wiper plug means and moving the volume of cement slurry through the liner between the lower wiper plug means coupled with the lower pump down plug and the upper wiper plug means coupled with the second upper pump down plug.

6. The method as set forth in claim 5 and further including the step of placing the annular volume between the tubular member and the liner above the sealing means on the upper wiper plug means in fluid communication with the interior of the tubular member by a one way fluid pressure bypass for equalizing higher pressure in the annular volume to lower pressure in the tubular member prior to and during the movement of the volume of cement slurry through the string of tubing or drill pipe for preventing premature release of said upper wiper plug means due to differential pressure.

7. A wiper plug system for use in cementing tubular liners in a well bore including, a tubular support member adapted for positioning within a tubular liner in a well bore and having a smaller diameter than the diameter of a tubular liner, a first tubular wiper plug means comprised of:

(a) a tubular body member having an upper tubular portion, an intermediate tubular portion and a lower tubular portion, (b) attaching means on said upper tubular portion including flexible finger members arranged to be slidably and releasably received in an open lower end of said tubular support member, (c) elastomer upwardly facing cup sealing members on said intermediate tubular portion for sealing engagement with the wall of the tubular liner, (d) a tubular sleeve valve member releasably coupled in said lower tubular portion at a first location above a terminal or end portion of said lower tubular portion, said sleeve valve member being movable to a second location adjacent said terminal or end portion of said lower tubular portion, means on said tubular sleeve valve member for sealingly receiving and for locking a cementing pump down plug in said sleeve valve member so that pressure can release and move said sleeve valve member from said first location to said second location, (e) first release means for releasably coupling said sleeve valve member to said lower tubular portion, (f) said lower tubular portion having port means located intermediate of said first and second locations of said sleeve valve member for placing the interior and exterior of said lower tubular portion in fluid communication when said sleeve valve member is displaced to said second location with a cementing pump down plug, (g) external locking means on said body member for latching the body member in a landing collar and for preventing upward movement of said body member relative to the landing collar, second release means for releasably securing said attaching means to said tubular support member, said second release means being arranged for release upon receipt of a cementing pump down plug in said sleeve valve member and said first release means being arranged for release when said body member is in the landing collar.

8. The apparatus as set forth in claim 7 and further including:

a second wiper plug member having (a) a second tubular member with an upper portion slidably received over the end of said tubular support member, (b) elastomer, upwardly facing up sealing members on said tubular member for sealing engagement with the wall of a tubular liner, and (c) internal landing means in the bore of said second tubular member for sealingly receiving and for locking a second cementing pump down plug in the bore of said second wiper plug member, third release means for releasably securing said tubular member to said tubular support member, said finger members of said first liner wiper plug member being disposed within said tubular member and disposed over said internal landing means.

9. A system for cementing well liners in a well bore traversing earth formations comprising;

tubular means for suspending a tubular liner in a well bore and having an open ended tubular member, upper and lower tubular liner wiper plug members, said upper wiper plug member having an upper inner bore adapted to be received on the open end of said tubular member and having outer wiper seal means for engaging the inner wall of a tubular liner, first shear means for releasably coupling the upper liner wiper plug member to said tubular member, passageway means in said upper liner wiper plug member for placing the exterior of the upper liner wiper plug member in fluid communication with the interior of said tubular member and including check valve means for permitting fluid flow in one direction from the exterior of the upper liner wiper plug member into the interior of said tubular member, said upper liner wiper plug member having an internal upwardly facing landing shoulder extending inwardly of the bore of said tubular member, said lower liner wiper plug member including a tubular body member having outer wiper seal means disposed intermediate of the length of the tubular body member for engaging the inner wall of a tubular liner, said tubular body member having elongated lengthwise extending collet finger members at the upper end of said tubular body member where the terminal ends of said collet finger members are located within the bore of said open ended tubular member at a location above the landing shoulder on the first liner wiper plug member, second shear means for releasably coupling said collet finger members to said open ended tubular member, a tubular ring sleeve member slidably disposed within the bore of the tubular body member at a location below the collet fingers and above the lower end of the tubular body member where the location is above the lower end of the tubular body member by a spacing at least equal to the effective sealing length of a cementing pump down plug, said ring sleeve member having means for receiving and for latching the cementing pump down plug in the ring sleeve member, and third shear means for releasably coupling said ring sleeve member to said tubular body member, said tubular body member having ports disposed above said lower end of the tubular body member and below the ring sleeve member so that movement of the ring sleeve member from a first upper position to a second lower position places the exterior of the tubular body member into fluid communication with the interior of the tubular body member, and passageway means in said tubular member above said upper liner wiper plug means, said passageway means including check valve means for permitting fluid flow in one direction from the exterior of said tubular member to the interior of said tubular member.

10. A system for cementing well liners in a well bore traversing earth formations comprising;

tubular means for suspending a tubular liner in a well bore and having an open ended tubular member, upper and lower tubular liner wiper plug members, said upper wiper plug member having an upper inner bore adapted to be received on the open end of said tubular member and having outer wiper seal means for engaging the inner wall of a tubular liner, first shear means for releasably coupling the upper liner wiper plug member to said tubular member, said upper liner wiper member having an internal upwardly facing landing shoulder extending inwardly of the bore of said tubular member, said lower liner wiper plug member including a tubular body member having outer wiper seal means disposed intermediate of the length of the tubular body member for engaging the inner wall of a tubular liner, said body member having elongated, lengthwise extending collet finger members at the upper end of said tubular body member where the terminal ends of said collet fingers members are located within the bore of said tubular member at a location above the landing shoulder on the first liner wiper plug member, second shear means for releasably coupling said tubular body member to said tubular member, a tubular ring sleeve member slidably disposed within the bore of the tubular body member at a location below the collet fingers and above the lower end of the tubular body member where the location is above the lower end of the tubular body member by a spacing at least equal to the effective length of a cementing pump down plug, said ring sleeve member having means for receiving and for latching a cementing pump down plug in the ring sleeve member, and third shear means for releasably coupling said ring sleeve member to said tubular body member, and said tubular body member having ports disposed above said lower end of the tubular body member and below the ring sleeve member so that movement of the ring sleeve member from an first upper position to a second lower position places the exterior of the tubular body member into fluid communication with the interior of the tubular body member.

11. A system for cementing well liners in a well bore traversing earth formations comprising;

tubular means for suspending a liner in a well bore and having an open ended tubular member, upper and lower tubular liner wiper plug members, said upper liner wiper plug member having an upper inner bore adapted to be received on the open end of said tubular member and having outer wiper seal means for engaging the inner wall of a tubular liner, first shear means for releasably coupling the upper liner wiper plug member to said tubular member, passageway means in said upper liner wiper plug member for placing the exterior to the upper liner wiper plug member in fluid communication with the interior of said tubular member and including check valve means for permitting fluid flow in one direction from the exterior into the interior of said tubular member, said upper liner wiper plug member having an internal upwardly facing landing shoulder extending inwardly of the bore of said tubular member, said lower liner wiper plug member including a tubular body member having outer wiper seal means disposed intermediate of the length of the tubular body member for engaging the inner wall of a tubular liner, said tubular body member having elongated, lengthwise extending collet finger members at the upper end of said tubular body member where the terminal ends of said collet fingers members are located within the bore of said open ended tubular member at a location above the landing shoulder on the first liner wiper plug member, second shear means for releasably coupling said body member to said open ended tubular member, means for receiving and for latching to a pump down plug said lower wiper member, and and passageway means in said open ended tubular member above said upper liner wiper plug means, said last mentioned passageway means including check valve means for permitting fluid flow in one direction from the exterior of said tubular member to the interior of said tubular member.

12. Apparatus for use in cementing a well liner in a well bore traversing earth formations including:

a tubular member having means adapted for coupling to a string of tubing;

upper and lower tubular liner wiper plug means where each of said liner wiper plug means have a sealing relationship to the inner wall of a liner and where each of said liner wiper plug means are releasably connected to said tubular member;

said lower liner wiper plug means have a bore with a tubular, releasable valve sleeve in a said bore, said valve sleeve being sized for sealingly receiving a first cementing pump down plug, a valve passageway located in said lower liner wiper plug means below said valve sleeve so that said valve sleeve, upon release is longitudinally movable relative to the liner wiper plug means to open said valve passageway for placing the interior of the lower liner wiper plug means in fluid communication with the exterior of the lower liner wiper plug means after engagement of the liner wiper plug means with a landing collar in a liner, said upper liner wiper plug means having a bore for sealingly receiving a second cementing pump down plug.

13. The apparatus as set forth in claim 12 and further including means in said tubular member for providing a one way fluid pressure bypass between the exterior of the tubular member above the upper liner wiper plug means and the interior of the tubular member.

14. The apparatus as set forth in claim 12 and further including means in said upper liner wiper plug means for providing a one way fluid pressure bypass between the upper and lower liner wiper plug means and the interior of the tubular member.

15. The apparatus as set forth in claim 12 and further including means in said tubular member for providing a one way fluid pressure bypass above the upper liner wiper plug means and the interior of the tubular member and means in said upper liner wiper plug means for providing a one way fluid pressure bypass betwee the upper and lower liner wiper plug means and the interior of the tubular member.

16. Apparatus for use in cementing a well liner in a well bore traversing earth formations including:

a tubular member having tubular upper and lower liner wiper plug means releasably connected thereto, said upper and lower liner wiper plug means having sealing elements for sealing relationship to the inner wall of a liner, means in one of said liner wiper plug means for providing a one way fluid pressure bypass between the upper and lower liner wiper plug means on the tubular member to the interior of the tubular members, means for coupling a first cementing pump down plug in a sealing relationship in the bore of said lower liner wiper plug means;

means for releasing the lower liner wiper plug means from the tubular member to permit the lower liner wiper plug means and the first cementing pump down plug to move downwardly as an assembly in the liner, means for coupling a second cementing pump down plug in a sealing relationship in the bore of said upper linear wiper plug means, and means for releasing the upper liner wiper plug means from the tubular member for permitting the upper liner wiper plug means and the second pump down plug to move downwardly in the liner.

17. The apparatus as set forth in claim 16 and further including means in said tubular member for providing a one way fluid pressure bypass between above the upper liner wiper plug means and the interior of the tubular member.

18. The apparatus as set forth in claim 17 and further including means for providing a releasable tubular valve sleeve in the lower wiper plug means for receiving a first cementing pump down plug, means for coupling the lower liner wiper plug means and a first cementing pump down plug to a liner wiper plug catcher in a liner, means for releasing the releasable valve sleeve in the lower liner wiper plug means and moving the first cementing pump down plug and valve sleeve downwardly relative to the lower liner wiper plug means, and means for providing a valve opening in the lower liner wiper plug means to place the interior of the lower liner wiper plug means in fluid communication in the the exterior of the lower liner wiper plug means.

19. Apparatus for use in cementing a well liner in a well bore traversing earth formations including:

a tubular member adapted for coupling to a string of tubing, a tubular liner wiper plug means having sealing elements for providing a sliding and sealing relationship relative to the wall of a liner, releasable means for releasably connecting said liner wiper plug means to said tubular member, and one way pressure bypass meand located above said sealing elements for placing the annulus above said sealing elements in fluid communication with the bore of said tubular member for preventing premature release of said releasable means.

20. Apparatus for use in cementing a well liner in a well bore traversing earth formations including:

upper and lower tubular liner wiper plug means, each of said liner wiper plug means having sealing elements for providing a sliding and sealing relationship relative to the wall of a liner, a tubular member adapted for coupling to a string of tubing, first releasable means for releasably connecting said upper wiper plug means to said tubular member, second releasable means for releasably connecting siad lower wiper plug means to said tubular member, first one way bypass means located between said sealing elements of said upper and lower wiper means for placing the annulus between said sealing elements in fluid communication with the bore of said tubular member for preventing premature release of a liner wiper plug means.

* * * * *